United States Patent [19]

Beschoner et al.

[11] 4,008,082

[45] Feb. 15, 1977

[54] METHOD FOR PRODUCING AN ELECTROPHOTOGRAPHIC RECORDING MATERIAL

[75] Inventors: Hans-Hermann Beschoner, Bad Westernkotten; Hartmut Dulken, Belecke; Gottfried Guder, Belecke; Karl-Heinz Kassel, Belecke, all of Germany

[73] Assignee: Licentia Patent-Verwaltungs-G.m.b.H., Frankfurt am Main, Germany

[22] Filed: Apr. 19, 1976

[21] Appl. No.: 678,386

Related U.S. Application Data

[63] Continuation of Ser. No. 442,319, Feb. 14, 1974, abandoned.

[30] Foreign Application Priority Data

Feb. 19, 1973 Germany ..... 2308070

[52] U.S. Cl. ..... 96/1.5; 427/76; 427/248 J; 427/402; 252/501

[51] Int. Cl.[2] ..... G03G 5/04; C23C 13/02

[58] Field of Search ..... 96/1.5; 427/76, 248 I, 427/402; 313/96; 252/501

[56] References Cited

UNITED STATES PATENTS

| | | | |
|---|---|---|---|
| 2,803,542 | 8/1957 | Ullrich | 96/1.5 |
| 3,634,134 | 1/1972 | Trubisky et al. | 96/1.5 X |
| 3,655,377 | 4/1972 | Sechak | 96/1.5 |
| 3,712,810 | 1/1973 | Ciuffini | 252/501 X |
| 3,775,109 | 11/1973 | Ohta et al. | 252/501 X |
| 3,785,806 | 1/1974 | Henriksson | 96/1.5 X |
| 3,861,913 | 1/1975 | Chiou | 96/1.5 |
| 3,904,408 | 9/1975 | Hanada et al. | 96/1.5 |

FOREIGN PATENTS OR APPLICATIONS

| | | | |
|---|---|---|---|
| 2,158,333 | 5/1973 | Germany | 96/1.5 |

*Primary Examiner*—Roland E. Martin, Jr.
*Attorney, Agent, or Firm*—Spencer & Kaye

[57] ABSTRACT

In the fabrication of an electrophotographic recording material composed of a photoconductive layer of selenium, at least one selenium alloy, or at least one selenium compound applied to a conductive substrate, the quality and durability of the bond between the layer and the substrate is improved by initially vapor-depositing a thin layer of the photoconductive substance while the substrate temperature is above the glass transformation temperature of the substance, and then vapor-depositing the remainder of the intended layer at a substantially lower substrate temperature.

4 Claims, No Drawings

METHOD FOR PRODUCING AN ELECTROPHOTOGRAPHIC RECORDING MATERIAL

CROSS REFERENCE TO RELATED APPLICATION

This application is a continuation of application Ser. No. 442,319, filed Feb. 14, 1974, now abandoned.

BACKGROUND OF THE INVENTION

The present invention relates to a method for producing an electrophotographic recording material of the type composed of selenium, selenium alloys or selenium compounds applied to a conductive carrier.

Electrophotographic methods and apparatus are widely used in the reproduction art. They utilize the property of such photoconductive material whereby its electrical resistance changes when it is exposed to a suitable activating radiation.

By electrically charging a photoconductive layer and then exposing it to such activating radiation in a pattern determined by an optical image, it is possible to produce thereon a latent electrical charge image which correponds to the optical image. At the exposed points there occurs such an increase in the conductivity of the photoconductive layer that a part or substantially all of the electrical charge can flow off through the conductive carrier while at the unexposed points the electrical charge remains substantially unchanged. More precisely, the quantity of charge flowing off is greater at the exposed points than at the unexposed points. The latent image can be made visible with a picture powder, a so-called toner, and the resulting toner image can finally be transferred to paper or some other medium, if this should be required.

Organic as well as inorganic substances are used as the electrophotographically active substances. Among them, selenium, selenium alloys and selenium compounds have gained particular importance.

In order to produce pictures having good contrast and sharpness, it is necessary, inter alia, for the charge applied to the photoconductive layers to flow out from the exposed parts after exposure uniformly and without interference. For this, an intimate and uniform contact between the conductive layer substrate and the photoconductive layer is required. Since the layer substrate and the photoconductive layer are composed of substances having very different coefficients of thermal expansion, the requirement for intimate and uniform contact can be met only with difficulty in the known embodiments of electrophotographic recording materials. This applied particularly to arsenic-containing selenium alloys having more than 20 percent by weight arsenic, such as $As_2Se_3$, which is applied, for example, to a glass substrate with a conductive intermediate layer of tin dioxide. Such layers have only poor adhesion which adversely affects their application.

If the photoconductive layer is applied by vapor deposition at a high substrate temperature, particularly at a temperature above the glass transformation temperature, the substrate is initially well wetted by the photoconductive layer. It should be noted that the "transformation temperature" of glass is defined as being that temperature at which glass has a viscosity of $10^{13.4}$ poises. However, when the substrate is cooled to room temperature, stress cracking resulting from the different coefficients of expansion of the layer and the substrate causes the photoconductive layer to come loose from the substrate.

If, on the other hand, the vapor-deposition is effected at low temperatures in order to avoid stresses during cooling, the wetting of the substrate by the photoconductive layer is so poor that the photoconductive layer will also soon come loose from the substrate.

SUMMARY OF THE INVENTION

It is an object of the present invention to eliminate these drawbacks.

It is a more specific object of the present invention to improve the adhesion of a photoconductive layer to a substrate in which the photoconductive layer and substrate have different coefficients of expansion.

This and other objects of the present invention are accomplished, in a process for producing an electrophotographic recording material of selenium, selenium alloys or selenium compounds applied to a conductive carrier, by initially vapor-depositing a very thin layer of the photoconductive substance onto the substrate while maintaining the substrate at a temperature above the glass transformation temperature of the photoconductive substance and, thereafter, during or after reduction of the substrate temperature, vapor-depositing the remainder of the intended layer thickness of photoconductive material at least the predominant part of such remainder being deposited at a substrate temperature substantially below such glass transformation temperature.

DESCRIPTION OF THE PREFERRED EMBODIMENTS

In performing the method according to the invention, it is advisable for the first deposited layer to have a thickness of about $1\mu$. For an arsenic-containing selenium alloy whose composition correponds approximately to $As_2Se_3$, it is advisable to apply the first partial layer at a temperature above 180° C and preferably at about 200° C. The remaining partial layer, for example about $10\mu$ in thickness, is vapor-deposited predominantly at a temperature below about 100° C and preferably at about 60° C. All other conditions of the vapor-deposition operations are in accordance with standard practice in the art.

Photoconductive layers which are deposited onto a substrate according to the method of the present invention have been found to adhere very well and permanently. Due to the high deposition temperature of the first-applied partial layer, the layer exhibits good wetting and on the other hand it is not endangered by stresses produced during cooling. Since only a very thin layer is deposited at the higher temperature, and thus only this very thin layer is cooled, the adhesion is not adversely influenced.

A further advantage of the method according to the present invention compared to a method in which the vapor-deposition takes place at high substrate temperatures exclusively, is the better utilization of the deposition material. Since the predominant portion of the layer is vapor-deposited at low temperatures, no significant re-evaporation takes place from the substrate surface.

According to a second example of an electrophotographic recording material to be used at about −40° C, the material to be vapor-deposited is pure selenium. It is advisable for the first deposited layer to have a thickness of about 1 $\mu$ and to apply at a temperature of about 60° C. The remaining partial layer, for example about 9 $\mu$ in thickness, is vapor-deposited at a temperature of about −40° C.

A further example of the material to be vapor-deposited is a selenium alloy containing 25 percent by weight arsenic. The first layer has a thickness of about 1 $\mu$ and is vapor-deposited at a temperature of about 150° C, the remaining partial layer, for example 9 $\mu$ in thickness, is vapor-deposited at a temperature below 60° C.

It is possible and sufficient for the first deposited layer to have a variation of the thickness of about 0.1 to 2.0$\mu$. The thickness of the second layer is variable within a broad range.

The rate at which the temperature of the substrate is reduced after the deposition of the first partial layer is about half an hour.

The substrate is a usual glass with a thickness of about 1 mm, the conductive intermediate layer deposited on the substrate prior to the deposition of the photoconductive layer is "Genell" from the firm Deutsche Balzers, Geisenheim, Germany, i.e. a transparent material containing $SnO_2$ in the main.

It will be understood that the above description of the present invention is susceptible to various modifications, changes and adaptations, and the same are intended to be comprehended within the meaning and range of equivalents of the appended claims.

We claim:

1. In a method for producing an electrophotographic recording material composed of a layer of a photoconductive substance comprising an arsenic-selenium alloy whose composition approximately corresponds to $As_2Se_3$ applied to a conductive substrate, the improvement comprising: initially vapor-depositing a first layer of the photoconductive substance to a thickness of about 0.1 to 2.0$\mu$ and substantially less than that of the completed layer onto the substrate while maintaining the substrate at a temperature which lies above the glass transformation temperature of the photoconductive substance; and subsequently vapor-depositing a second layer of the substance to a thickness equal to the remainder of the intended complete layer thickness, at least the major part of the second layer being vapor-deposited while maintaining the substrate at a temperature substantially lower than such transformation temperature and at least more than 80° C less than such transformation temperature.

2. Method as defined in claim 1 wherein the first layer is deposited to a thickness of approximately 1$\mu$.

3. Method as defined in claim 1 wherein the first layer is deposited at a temperature above 180° C and at least such major part of the second layer is deposited at a temperature of less than 100° C.

4. Method as defined in claim 3 wherein the first layer is deposited at a temperature of about 200° C and at least such major part of the second layer is deposited at a temperature of less than about 60° C.

* * * * *